United States Patent [19]

MacLeod et al.

[11] Patent Number: 4,856,740

[45] Date of Patent: Aug. 15, 1989

[54] MULTI-PURPOSE INDOOR/OUTDOOR REFUSE BAG SUPPORT

[76] Inventors: Edwin A. MacLeod, 1133 Pipeline Road, #89, Port Coquitlam, BC, Canada, V3B 4R8; E. Wesley Frank, P.O. Box 873, Sumas, Wash. 98295

[21] Appl. No.: 164,544

[22] Filed: Mar. 7, 1988

[51] Int. Cl.[4] ..... B65B 67/12

[52] U.S. Cl. ..... 248/97; 248/99; 248/156; 248/286

[58] Field of Search ..... 248/97, 98, 99, 100, 248/101, 156, 532, 533, 237, 285, 286, 188.5

[56] References Cited

U.S. PATENT DOCUMENTS

| | | | |
|---|---|---|---|
| 62,741 | 3/1867 | Gano | 248/97 |
| 128,073 | 6/1872 | Roseborough, Jr. . | |
| 363,780 | 5/1887 | Wright et al. . | |
| 434,514 | 8/1890 | Lamb | 248/100 X |
| 630,684 | 8/1899 | Goldsmith | 248/97 |
| 791,379 | 5/1905 | Terry | 248/97 |
| 812,157 | 2/1906 | Thompson . | |
| 841,621 | 1/1907 | Campbell | 248/97 |
| 894,295 | 7/1908 | Stoops | 248/237 |
| 909,012 | 1/1909 | McCarty | 248/237 |
| 1,133,878 | 3/1915 | Nagel | 248/237 |
| 2,451,829 | 10/1948 | Hightower | 248/100 |
| 2,472,410 | 6/1949 | Ferrell et al. | 248/97 |
| 2,683,009 | 7/1954 | Owens | 248/97 |
| 3,532,314 | 10/1970 | Vosbikian . | |
| 3,604,677 | 9/1971 | Gits . | |
| 3,638,888 | 2/1972 | Ross | 248/97 |
| 3,744,081 | 7/1973 | Miller | 248/101 X |
| 3,866,872 | 2/1975 | Burgess . | |
| 3,876,970 | 4/1975 | Schweitzer | 248/156 X |
| 3,901,433 | 8/1975 | Jacobs et al. . | |
| 4,140,296 | 2/1979 | Guillen | 248/286 X |
| 4,312,489 | 1/1982 | Paetzold . | |
| 4,318,521 | 3/1982 | Martin et al. . | |
| 4,319,726 | 3/1982 | Andersson . | |

FOREIGN PATENT DOCUMENTS

| | | | |
|---|---|---|---|
| 509868 | 3/1952 | Belgium | 248/97 |

*Primary Examiner*—J. Franklin Foss
*Assistant Examiner*—David L. Talbott

[57] ABSTRACT

A portable, collapsible, articulated refuse bag support assembly (20) including: (i) a ground/floor engaging base subassembly (21) having a T-shaped support base (25); (ii) an axially extending upright support stanchion subassembly (22) pivotally connected at one end to the ground/floor engaging base subassembly (21) by a releasable locking mechanism (48, 49); and (iii), a rectilinear refuse bag engaging support subassembly (24) pivotally connected to the upright support stanchion assembly (22) by a releasable locking mechanism (62, 64) and including a pair of mating, telescopically mounted, C-shaped support element (50, 51) each including an intermediate leg (52), a first tubular member (54) coupled to one end of the leg (52) and a second tubular member (55) coupled to the opposite end of the intermediate leg (52) with the two (2) tubular members (54, 55) being parallel to one another and normal to the intermediate leg (52) and having different diameters to permit telescopic slidable mounting of the first and second and second and first tubular members (54, 55 and 55, 54) on respective different ones of the C-shaped support elements (50, 51) for permitting adjustment of the rectilinear size of the bag engaging support subassembly (24) to accommodate refuse bags (65) having different sizes. The ground/floor engaging base subassembly (21) preferably includes an intermediate support leg (32) sandwiched between a pair of spaced apart parallel support legs (29, 30) and pivotally connected thereto by a releasable locking mechanism (34, 36) so as to enable deployment in either a two dimensional or three dimensional configuration; while the upright vertical support stanchion subassembly (22) includes an intermediate upright (42) sandwiched between, and pivotally connected to, a pair of parallel spaced apart support uprights (38, 39) by a releasable locking mechanism (45, 46) and with the intermediate support tight (42) being pivotally connected at one end to the ground/floor engaging base subassembly (21) by the releasable locking mechanism (48, 49) and a sharpened bayonet-like opposite extremity (71) which can be driven into the ground for support purposes.

10 Claims, 5 Drawing Sheets

MULTI-PURPOSE INDOOR/OUTDOOR REFUSE BAG SUPPORT

BACKGROUND OF THE INVENTION

1. Technical Field

The present invention relates generally to refuse bag supports; and, more particularly, to a lightweight, rugged, articulated, refuse bag support that: (i) permits of both indoor and outdoor use; (ii) is readily adjustable for use with a wide range of different types and sizes of refuse bags; (iii) can be used to maintain a refuse bag open for ease of loading in either the upright vertical state or in a horizontal state when one wishes to simply sweep, or rake, refuse into the open bag; (iv) can be firmly affixed in, or seated on, virtually any type of surface, whether a flat floor, driveway, lawn or the like, or on rough irregular surfaces such as stair steps, hills and the like; and (v), can be easily collapsed into a compact, generally flat, planar configuration occupying a minumum volume of space when not in use.

More specifically, the present invention relates to an articulated refuse support assembly including: (i) a ground/floor engaging base subassembly; (ii) a generally upright support stanchion subassembly; and (iii), an adjustable bag engaging support subassembly capable of supporting the periphery of the open end of virtually any sized conventional refuse bag in the open state. The ground/floor engaging base subassembly is adjustable in either a two dimensional or a three dimensional configuration so that it can be adapted to sit on flat surfaces or non-flat surfaces; the upright support stanchion subassembly is axially extendable to readily accommodate refuse bags of different lengths and includes provision for being projected into the ground in either a generally upright, vertical position or in a position wherein the main portion of the support stanchion subassembly is generally parallel to the ground and spaced above the ground by a distance of a foot or so; and, the bag engaging support subassembly includes mating, opposed, telescopically mounted C-shaped portions defining a rectilinear opening that can be easily expanded and/or contracted to conform in peripheral size to the size of the particular refuse bag's peripheral wall surrounding the end opening.

2. Background Art

The prior art is replete with various patents that have issued over the years relating to special devices used for supporting lawn bags, garbage bags and similar types of refuse bags—normally, but not exclusively, in a generally vertical open state to facilitate loading thereof. For example, U.S. Pat. Nos. 4,319,726-Andersson and 4,312,489—Paetzold each disclose portable devices comprising an upright vertical pedestal having a sharpened lower end adapted to be driven into the ground, together with an upper, generally horizontally disposed, circular support for the open end of a lawn bag or the like. Both Andersson and Paetzold disclose the use of a separate base attachment that can be employed to support the refuse bag in an open upright state on a floor or the like; and, in each instance some degree of adjustment is available to accommodate bags of varying sizes. The Paetzold device is said to be capable of being disassembled for separate storage of its component parts. U.S. Pat. No. 3,604,677—Gits similarly shows a bag support ring mounted on the upper ends of a pair of diametrically opposed pedestals adapted to be driven into the ground.

Another patent of incidental interest is U.S. Pat. No. 3,866,872—Burgess which discloses a device similar to the bag supports described above except that the Burgess device includes a three-footed support member having telescopically mounted portions.

U.S. Pat. No. 4,318,521—Martin et al discloses a lawn refuse bag positioner comprising a hoop-like element adapted to support the open end of a lawn bag in the open state, with one side of the hoop-like element being flat so as to permit it to rest on the ground with the open end of the bag in a vertical plane, thus permitting refuse to be raked into the bag.

Other prior patents of purely incidential and/or cumulative interest include: 3,901,433—Jacobs et al [a stanchion for supporting a bag into which newspapers and the like can be placed]; 3,532,314–Vosbikian [a collapsible refuse bag holder quite similar in construction to those disclosed in the aforementioned Andersson and Paetzold patents]; 812,157–Thompson [a combined animal tether and feed bag which is collapsible]; 363,780–Weight et al [a portable bag holder having an upright support standard and a separate, angularly related, bracing member]; and, 128,073–Roseborough, Jr. [a portable bag holder having three (3) upright legs].

SUMMARY OF THE INVENTION

The present invention relates to a simple, yet highly effective and rugged, refuse bag support that can be readily adapted for indoor or outdoor use, and to virtually any type of floor or other terrain, be it flat and/or generally impenetrable such as a wood floor, a concrete or other paved surface, a staircase, or the like; or soft and penetrable such as a a lawn, hill, garden, etc. To accomplish this, the invention comprises a collapsible, articulated refuse bag support assembly having three (3) basic pivotally interconnected subassemblies—viz., (i) a ground/floor engaging base subassembly capable of either two dimensional or three dimensional adjustment to permit mounting on any type and shape of surface; (ii) a generally vertical upright support stanchion subassembly which can be supported on or in the ground and which permits adjustment both to accommodate tall and short bags and to support such bags in either a vertical position or lying close to the ground or floor in a generally horizontal state, yet with the bags open in either position; and (iii), a rectilinear bag engaging support subassembly which can be adjusted to accommodate virtually any size refuse bag and to support such bag in the open state with the open end of the bag lying in either a horizontal plane or in a vertical plane, in the latter case permitting refuse to be simply swept or raked into the open bag. Refuse supports embodying features of the present invention may, when not in use, be easily folded up into a flat, compact, generally planar configuration occupying a minumum amount of space for storage without requiring disassembly; and, when in use, may be easily adjusted to accommodate virtually any size or type of bag, and to support the same in an open state in virtually any desired position and on virtually any type of surface or terrain.

DESCRIPTION OF THE DRAWINGS

These and other objectives and advantages of the invention will become more readily apparent upon reading the following Detailed Description and upon reference to the attached drawings, in which.

Figure 1:
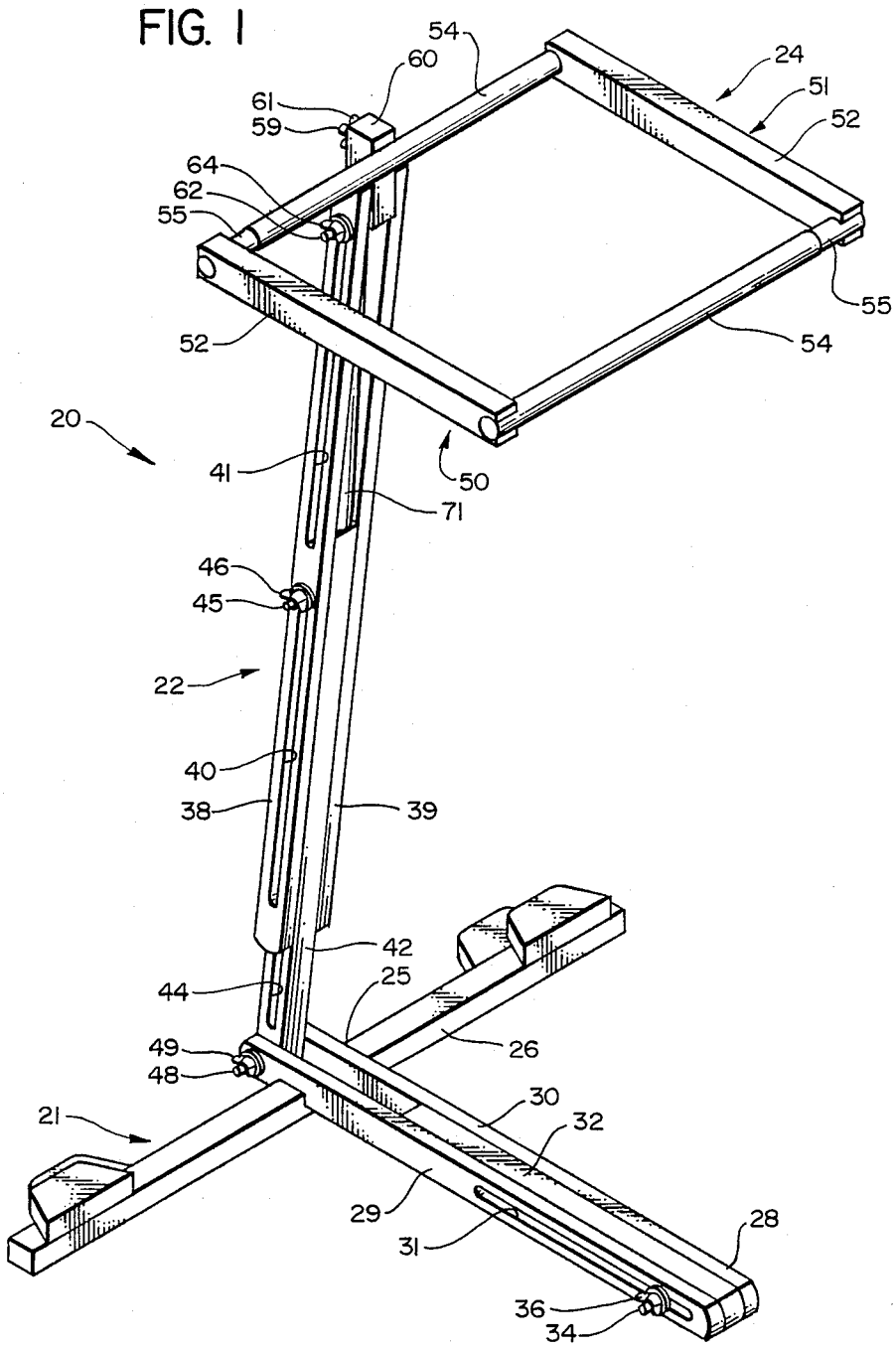
FIG. 1 is an isometric view of an exemplary refuse bag support assembly embodying features of the present invention, here illustrating the device in an assembled, deployed position ready to support a refuse bag in a generally vertically oriented open state on any type of generally flat surface, either indoors or outdoors.

While the invention is susceptible of various modifications and alternative forms, a specific embodiment thereof has been shown by way of example in the drawings and will herein be described in detail. It should be understood, however, that it is not intended to limit the invention to the particular form disclosed; but, on the contrary, the intention is to cover all modifications, equivalents and alternatives falling within the spirit and scope of the invention as expressed in the appended claims.

DETAILED DESCRIPTION

Turning now to the drawings, and first directing attention to FIG. 1, there has been illustrated an exemplary refuse bag support assembly, generally indicated at 20, embodying features of the present invention. As here shown, the exemplary support assembly 20 includes three (3) basic subassemblies—viz., (i) a ground/floor engaging base subassembly, generally indicated at 21; (ii) an axially extending upright support stanchion subassembly, generally indicated at 22; and (iii), a rectilinear refuse bag engaging support subassembly, generally indicated at 24. Each of the three (3) aforementioned subassemblies are described in greater detail hereinbelow. For the moment, suffice it to state that the ground/floor engaging base subassembly 21 includes a T-shaped base member 25 having a transverse support bar 26 and a bifurcated support element 28 defined by parallel, spaced apart bars 29, 30, each of which are provided with an axially extending through slot 30 (only one such slot 31—viz., the slot 31 in bar 29—is visible in FIG. 1). The parallel spaced apart bars 29, 30 serve to sandwich yet another ground/floor engaging base support bar 32 whose function will hereinafter be described in conjunction with the description of FIG. 7. As shown in FIG. 1, the ground/floor support bars 29, 30, 32 are held together by means of a bolt 34 passing through the slot 31 in bars 29, 30 and through a single slot (not visible in FIG. 1, but illustrated at 35 in FIG. 7) formed in bar 32 and a wing nut 36.

In carrying out the present invention, the generally upright support stanchion subassembly 22 consists of three (3) uprights—viz. spaced apart, parallel uprights 38, 39 each having a pair of axially extending through slots 40, 41 (only the slots 40, 41 in upright 38 are visible in FIG. 1), and an intermediate upright 42 having a single axially extending slot 44 passing therethrough. The uprights 38, 39, 42 are held together by means of a bolt 45 passing through the slots 40 in uprights 38, 39 and through slot 44 in intermediate upright 42, which bolt is secured in place by a wing nut 46. The lower end of intermediate upright 42 as viewed in FIG. 1 is pivotally connected to the ground/floor engaging base subassembly 21 by means of a bolt 48 extending through one end of the spaced apart substantially parallel bars 29, 30 and through the lower end of the intermediate upright 42 which is sandwiched therebetween and is secured in place by a wing nut 49.

In further keeping with the present invention, and as best illustrated by reference to FIGS. 1, 4, 5, and 6 conjointly, the refuse bag engaging support subassembly 24 includes a pair of mating C-shaped bag support elements, generally indicated at 50, 51, each having an intermediate leg 52, a tubular element 54 coupled to one end of the intermediate leg 52 and normal thereto, and a second tubular element 55 coupled to the opposite end of the intermediate leg 52 and normal thereto. The tubular member 54 preferably has an internal diameter slightly greater than the external diameter of tubular member 55, thus permitting the tubular member 55 on intermediate leg 52 of C-shaped element 50 to be slidably mounted within the larger diameter tubular member 54 associated with C-shaped element 51; while, at the same time, permitting the relatively small diameter tubular member 55 associated with C-shaped element 51 to be slidably mounted within the relatively large diameter tubular member 54 associated with C-shaped element 50. As best shown by reference to FIGS. 5 and 6 conjointly, one set of telescopically mounted tubular members 54, 55 are provided with axially extending aligned slots, 56, 59 respectively, through which a bolt 59 passes, such bolt also passing through a latching block 60 and being held in place by means of a wing nut 61.

Figure 6:
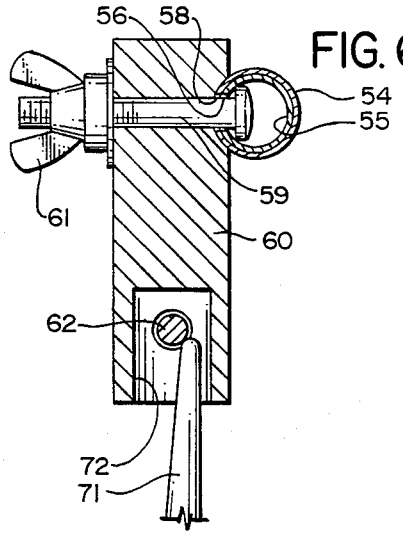
FIG. 6 is a sectional view taken substantially along the line 6—6 in FIG. 4, here illustrating those details enabling the bag engaging support subassembly to be locked in any desired position.

Thus, the arrangement is such that the C-shaped elements 50, 51 can be moved towards or away from one another so as to adjust the peripheral dimension of the bag engaging support subassembly 24 to define a rectilinear opening sized to accommodate a refuse bag (not shown in FIGS. 1, 4, 5 or 6) of any desired size by merely loosening wing nut 61 and sliding the telescopically mounted tubular members 54/55 towards or away from one another to a desired position; at which point the wing nut 61 is again tightened to latch the C-shaped elements 50, 51 together in a fixed position as best shown in FIG. 6.

In assembly of the device 20, the refuse bag engaging support subassembly 24 is pivotally connected to the upper end of the stanchion support subassembly 22 by means of a bolt/wing nut combination 62/64 wherein the bolt 62 passes through the uppermost ends of the slots 41 formed in uprights 38, 39 and through the lower end of the latching block 60.

Figure 2:
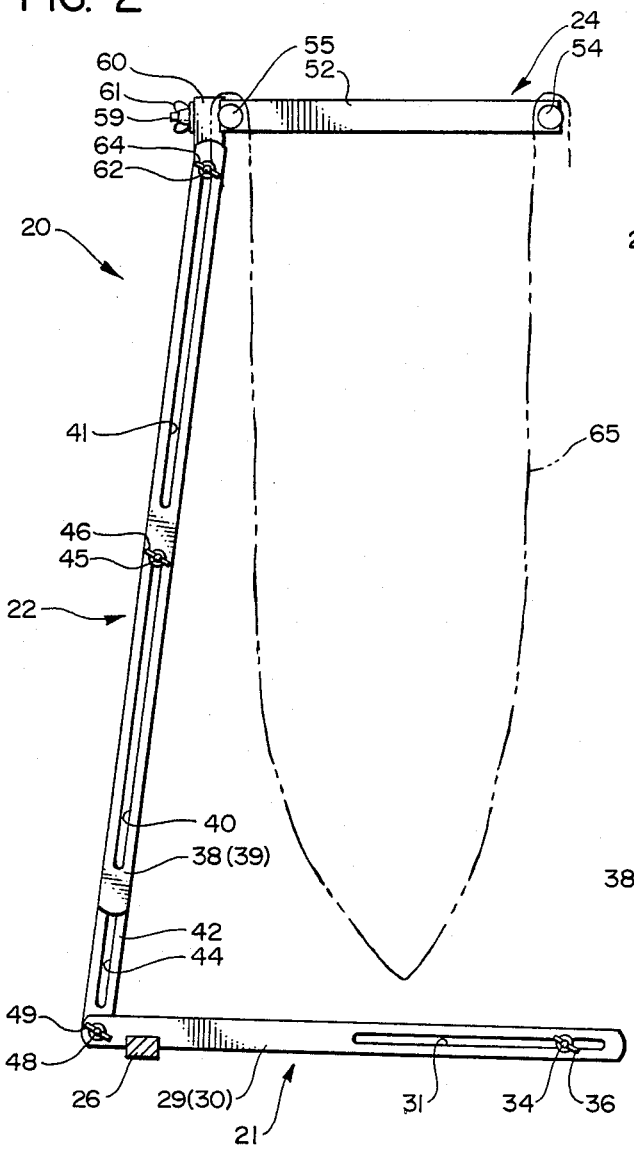
FIG. 2 is a side elevational view of the exemplary refuse bag support assembly of FIG. 1, here depicting a refuse bag in phantom lines as supported thereon with the upper open end of the bag lying in a generally horizontal plane.
Figure 3:
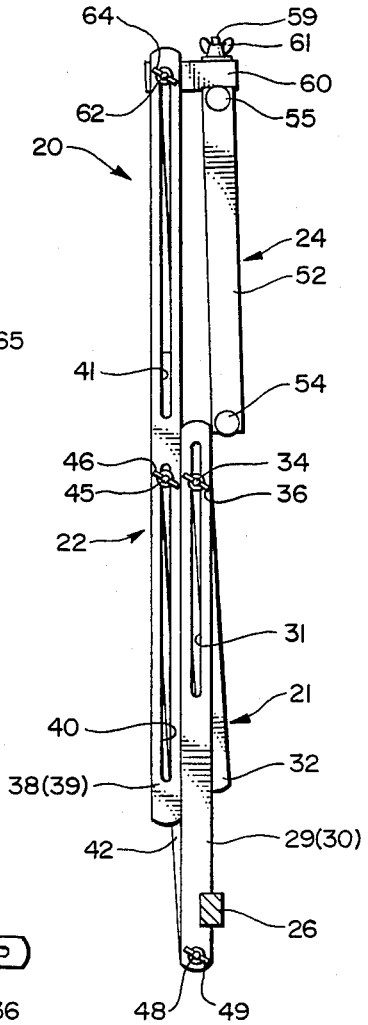
FIG. 3 is a side elevational view of the exemplary refuse bag support assembly of FIG. 1, here depicting the assembly in the flat or collapsed state suitable for storage when not in use.
Figure 4:
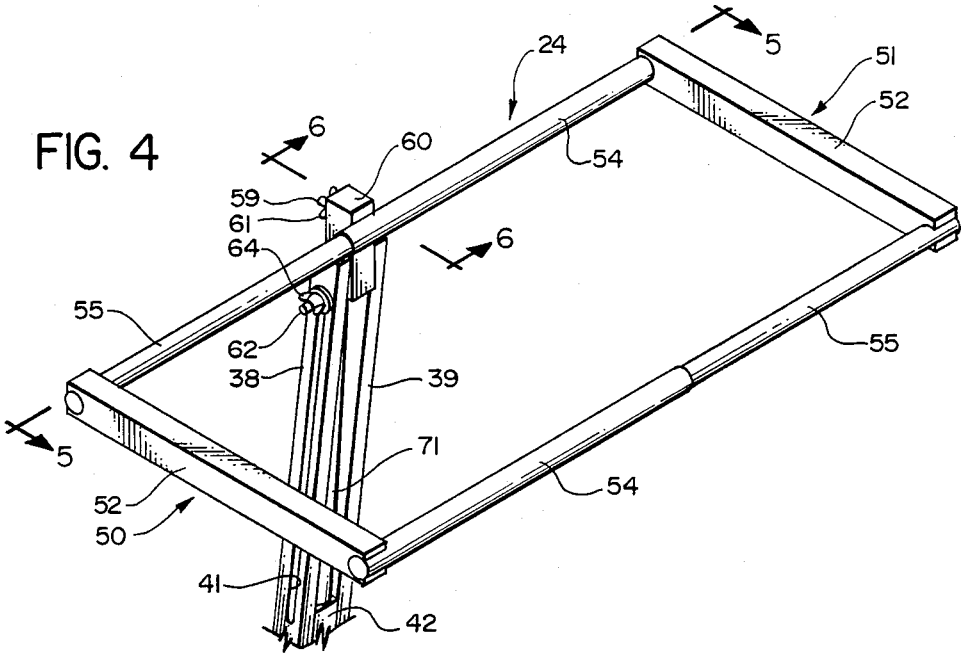
FIG. 4 is a fragmentary, isometric view of the bag engaging support subassembly, here shown in an expanded state suitable for accommodating relatively large refuse bags.
Figure 5:
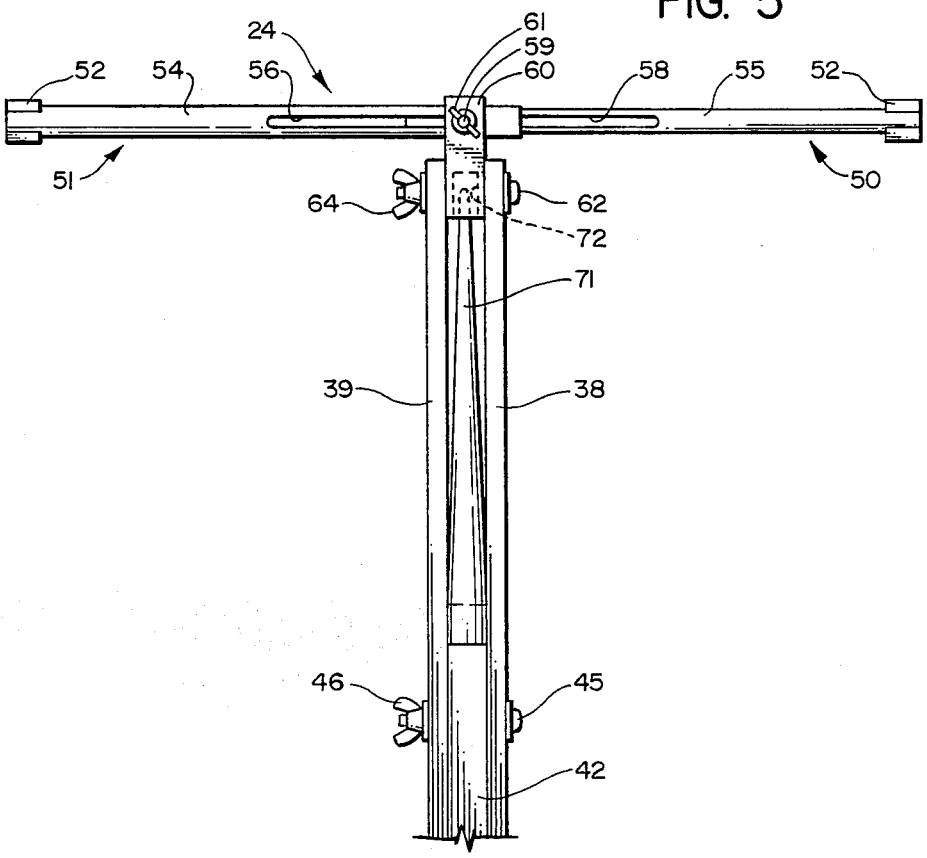
FIG. 5 is a fragmentary, rear elevational view taken substantially along the line 5—5 in FIG. 4 and depicting details of the exemplary refuse bag support assembly of the present invention.

Thus, considering FIGS. 1, 2 and 3 conjointly, it will be observed that the refuse bag support assembly 20 readily permits accommodation of virtually any size refuse bag—e.g., the bag 65 shown in FIG. 2 in phantom lines—in a suspended arrangement with its open mouth disposed in a generally horizontal plane irrespective of the size of the particular refuse bag employed. More specifically, the peripheral size of the open mouth of the bag can be accommodated by adjustment of the two (2) C-shaped support elements 50, 51 in the manner described above; while the refuse bag support assembly 20 can be made taller or shorter simply by loosening wing nut 46 and/or 64 and adjusting the bag support components of the overall assembly. For example, if the refuse bag 65 is taller than that shown in FIG. 2, wing nut 46 can be backed off, thereby permitting the user to slide the uprights 38, 39 upwardly relative to intermediate upright 42 so as to render the refuse bag support assembly 20 taller. Alternatively, if the refuse bag 65 is shorter than the bag 65 shown in FIG. 2, the user need merely loosen wing nut 64 and slide the latching block 60 downwardly to the desired height, thus lowering the bag engaging support subassembly 24 relative to the upright support stanchion subassembly 22. In either case, the user will desirably position the subassemblies 22, 24 so that the lowermost end of the bag 65 (FIG. 2) rests on the floor or ground when in use, thus insuring that the weight of the refuse placed in the bag 65 is supported by the floor or ground, rather than by the refuse bag support assembly 20.

When the user is finished with the refuse bag support assembly 20 and is ready to store the same, it is merely necessary to loosen the wing nut 49 which serves to lock the ground/floor engaging base subassembly 21 to the upright stanchion support subassembly 22 and pivot, or fold, the two (2) subassemblies into the closely spaced, generally parallel, collapsed state shown in FIG. 3; while also loosening wing nut 64 so as to permit pivoting, or folding, of the bag engaging support subassembly 24 downwardly into the position shown in FIG. 2. Thus, it is not necessary to dismantle the refuse bag support assembly 20; but, rather, it can be readily folded into a compact, collapsed condition as shown in FIG. 2 so that the storage space required is minimized.

Those skilled in the art will appreciate from the foregoing description considered in conjunction with FIGS. 1–6, that the exemplary refuse bag support assembly 20 is characterized by its portability and its adjustability to accommodate a wide variety of different size refuse bags and different terrain conditions. And, as thus far described, it will be apparent that when the user intends to deploy the support assembly 20, it can readily be unfolded from the collapsed, folded state shown in FIG. 3 and reconfigured in the deployed state depicted in FIG. 1. Thereafter, the bag engaging support subassembly 24 may be pivoted outwardly into a horizontal plane and adjusted to accommodate and support a given refuse bag 65 in the manner shown in FIG. 2—i.e., with the open end of the bag 65 being disposed in a horizontal plane. However, neither the invention nor the exemplary embodiment thereof as hereinabove described, are limited to either deployment of the support assembly 20 on a flat even surface as shown in FIGS. 1–6 or to deployment of the refuse bag 65 with its open end disposed in a horizontal plane as shown in FIG. 2.

Figure 7:
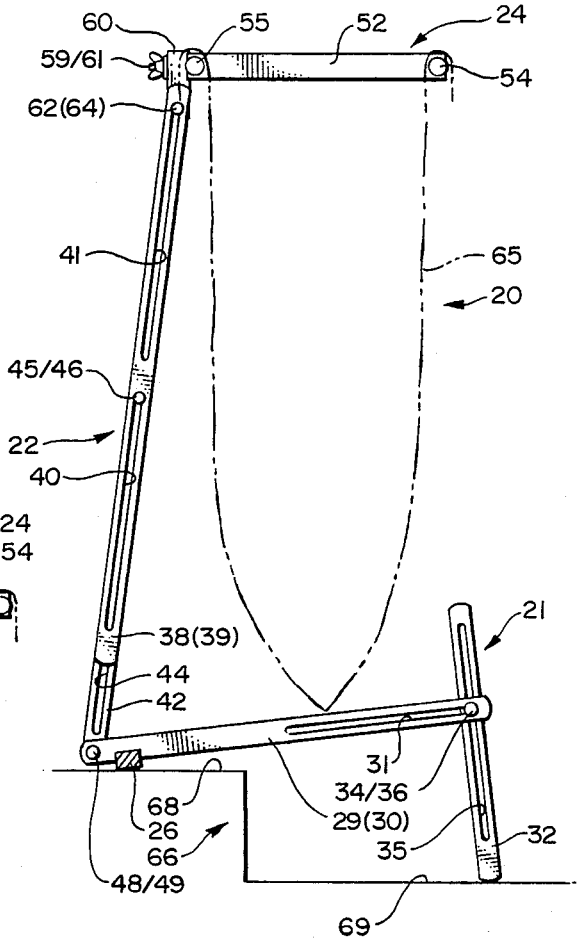
FIG. 7 is a side elevational view, somewhat similar to FIG. 2, but here illustrating the support assembly deployed to hold a refuse bag, shown in phantom, open on a set of stairs or other non-even surface.

Thus, referring first to FIG. 7, it will be noted that the exemplary refuse bag support 20 as hereinabove described readily permits deployment on uneven terrain or surfaces—such, for example, as on a staircase or set of steps as indicated generally at 66. To enable such deployment, it is merely necessary to rest the transverse support bar 26 of the ground/floor engaging base subassembly 21 on a given step or level 68, while pivoting the intermediate ground/floor engaging support bar 32 into a generally upright plane with its lowermost end bottomed on a lower stair or level 69, at which point the bar 32 is locked in position by means of the bolt/wing combination 34/36. Since the bolt 34 passes through the slot 31 located in the spaced apart support bars 29, 30, as well as through the slot 35 formed in intermediate bar 32, a wide range of adjustment is available, thus permitting usage of the refuse bag support 20 on highly irregular or uneven surfaces.

Figure 8:
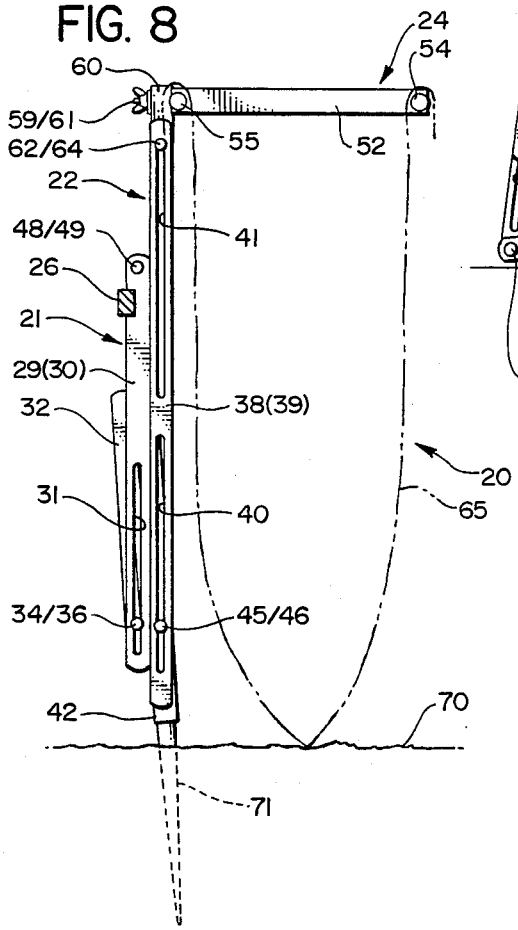
FIG. 8 is a side elevational view of the exemplary refuse bag support assembly of the present invention as it might be employed on lawns, in gardens, or in other outdoor environments where the soft ground permits the vertical upright support stanchion subassembly to simply be driven into the ground to support a refuse bag in a generally upright vertical position.

Turning next to FIG. 8, yet another method of permissable deployment of the exemplary refuse bag support assembly 20 has been depicted—a method which is particularly advantageous for use on lawns, or in gardens, or other areas where the ground or terrain is sufficiently soft as to permit driving a portion of the generally upright support stanchion subassembly 22 into the ground 70. Thus, referring first to FIGS. 1 and 6, it will be noted that the uppermost end of the intermediate upright 42 as viewed in these two (2) figures terminates in a sharpened bayonet-like projection 71 which, when not in use, lies entirely between the spaced-apart uprights 38, 39 and may have its uppermost sharpened extremity 71 retained captive within a bore or cavity 72 formed in the lower end of the latching block 60 which forms part of the bag engaging support subassembly 24 (FIG. 6).

When one desires to utilize the bayonet-like projection 71 on the intermediate upright 42 for purposes of support, it is merely necessary to: (i) loosen the two (2) bolt/wing nut combinations 45/46, 48/49 (FIG. 1); (ii) slide the intermediate upright 42 downwardly slightly relative to the spaced apart uprights 38, 39 so as to withdraw the sharpened bayonet-like projection 71 from the protective cavity 72 in latching block 60; (iii) rotate the intermediate upright 42 (for example, in a clockwise direction as viewed in FIG. 1) about the pivot point defined by bolt 45 through an angle approximating 180° to a position where the bayonet-like projection 71 is directed downwardly; (iv) simultaneously rotate the T-shaped base member 25 (for example, in a counterclockwise direction as viewed in FIG. 1) about the pivot point defined by bolt 48 through an angle approximating 270°; and v), retighten the bolt/wing nut combinations 45/46, 48/49 with the refuse bag support 20 in the configuration depicted in FIG. 8. At this point, the user need merely propel the sharpened bayonet-like tip 71 on the inverted intermediate upright 42 into the ground 70 so that the upright support stanchion subassembly 22 provides the sole support for the refuse bag support assembly 20—i.e., the ground/floor engaging base subassembly 21 is stored in an inoperative state, although it may remain coupled to the overall refuse bag support assembly 20 or, if desired, it may be removed from the assembly 20.

Figure 9:
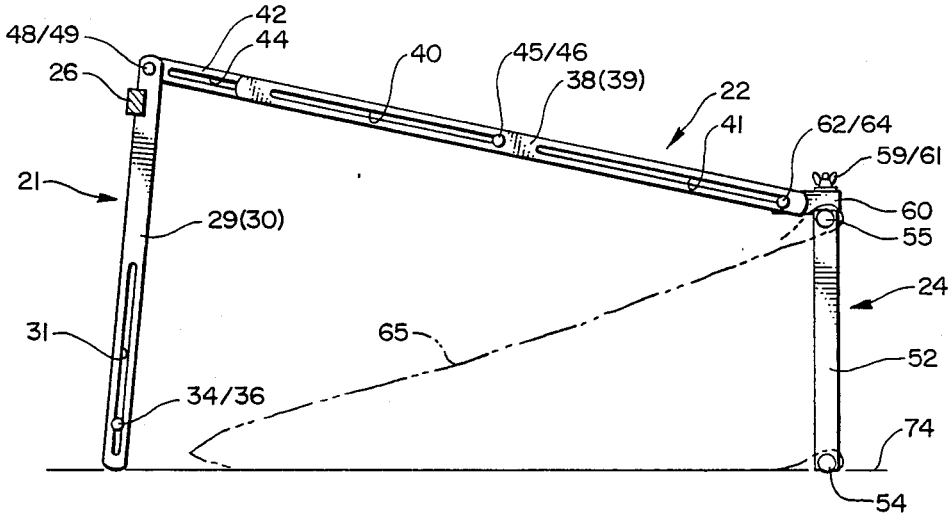
FIG. 9 is a side elevational view of the exemplary refuse bag support assembly of the present invention, here illustrating one manner in which the assembly can be deployed to hold a refuse bag (shown in phantom) or the like open while in a horizontal state so that refuse can simply be swept into the open end of the bag; and, FIG. 10 is a side elevational view similar to FIG. 9, but here illustrating a slightly modified method of deploying the support assembly when being used outdoors in condition to permit raking or sweeping of leaves or the like directly into the open refuse bag.

Referring next to FIG. 9, yet another method of deploying the exemplary refuse bag support assembly 20 has been illustrated, such method being particularly advantageous for indoor usage and/or usage on relatively hard, impenetrable surfaces. Thus, as here shown, the various subassemblies 21, 22 and 24 of the refuse bag support assembly 20 are configured in essentially the same manner as depicted in FIGS. 1 and 2 except that in this instance the entire assembly 20 has been turned on its side—i.e., through an angle of approximately 90° in a clockwise direction from the position shown in FIG. 2 to that shown in FIG. 9. In this condition, the extremity of the two (2) intermediate support legs 52 and the telescoped tubular members 54, 55 most remote from the upright support stanchion subassembly 22 rest on the floor 74 or other surface; and, because of the rectilinear configuration of the bag engaging support subassembly 24, the assembly 20 provides a highly stable support for maintaining the open end of the bag 65 in an open state lying in a plane normal to the floor 74, thus enabling the user to simply sweep or rake refuse into the open end of the bag 65. It will be understood that the free extremities of the ground/floor engaging support bars 29, 30 are also in contact with the ground 74 so as to provide a generally triangular support structure for the overall system.

Figure 10:
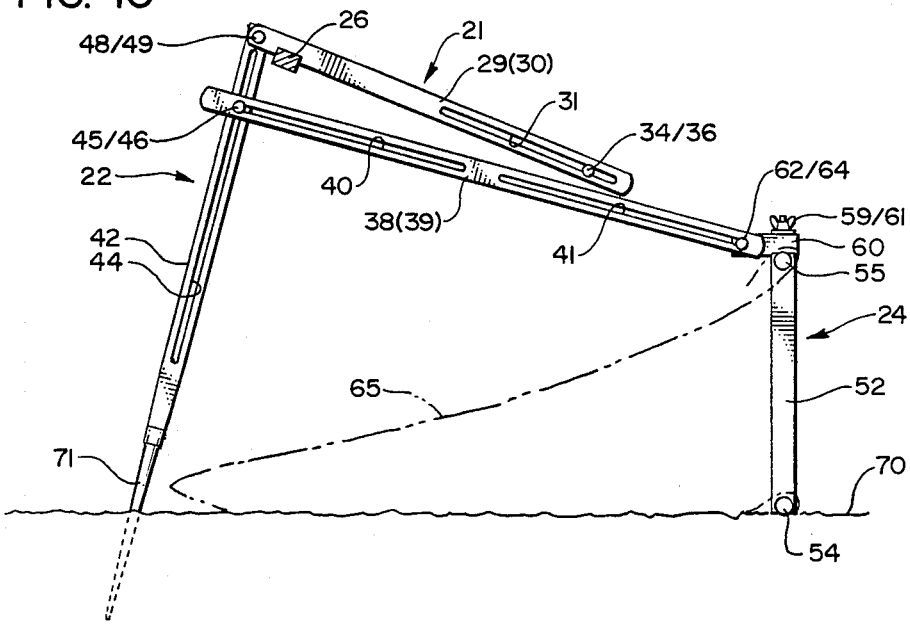

When using the exemplary refuse bag support assembly 20 outdoors—for example, to collect leaves, lawn cuttings, or the like, essentially the same deployment as described above in connection with FIG. 9 can be employed. Alternatively, if increased stability and/or resistance to the wind and the like is desired, the refuse bag support assembly 20 can be configured as shown in FIG. 10. Thus, in this usage of the invention, the sharpened bayonet-like projection 71 forming part of the intermediate upright 42 is released and rotated through an angle of approximately 90° so as to enable the user to propel the bayonet-like tip 71 into the groun 70. In this condition, the ground/floor engaging base subassembly 21 is, for all practical purposes, inoperative and may, if desired, be entirely removed from the support assembly 20, although such removal is not necessary since the subassembly 21 can be deployed in the inoperative state as shown in FIG. 10.

Thus, those skilled in the art will appreciate that there has, hereinabove, been described a highly versatile, simple, rugged, portable refuse bag support assembly which can be used with virtually any sized refuse bags and in virtually any indoor and/or outdoor environment. Because of its articulated construction wherein the three (3) basic subassemblies—ziv., the ground/-floor engaging base subassembly 21; the upright support stanchion subassembly 22; and, the bag engaging support subassembly 24—are pivotally connected to one another in such a manner that they can be readily locked in a wide variety of differing configurations, the exemplary refuse bag support assembly 20 can be used with equal facility on rough irregular terrain and/or on smooth flat surfaces, all irrespective of whether the particular support surface is hard and impenetrable—i.e., a wood or concrete floor, a paved driveway or the like—or a soft and penetrable surface—i.e., a lawn, garden or the like. Indeed, the very articulated nature of the construction which permits of such varied alternative deployments also permits the entire assembly to be folded up into a small compact state when not in use (FIG. 3) so as to facilitate storage and minimize the requirement for storage space.

We claim:

1. A portable, articulated, refuse bag support assembly comprising, in combination:

(a) a ground/floor engaging base subassembly including a generally T-shaped support base;

(b) an axially extensible upright support stanchion subassembly pivotally interconnected at its lowermost end to said ground/floor engaging base subassembly;

(c) first means for releasably locking said ground/-floor engaging base subassembly and said upright support stanchion subassembly together in any desired position defining an included angle therebetween ranging from approximately 0° to approximately 180°;

(d) a generally rectilinear bag engaging support subassembly pivotally interconnected at one edge thereof to said upright support stanchion subassembly, said generally rectilinear bag engaging support subassembly including: (i) a pair of mating telescopically interconnected C-shaped support elements adapted to be slidably moved away from one another and/or slidably moved towards one another so as to adjust the size of the rectilinear opening defined thereby to accommodate various sized refuse bags; and (ii), second means for releasably locking said pair of C-shaped support elements together in any desired position defining a rectilinear bag engaging support subassembly capable of supporting the open end of any conventional refuse bag; and, (e) third means for releasably locking said generally rectilinear bag engaging support subassembly and said upright support stanchion subassembly together in any desired position defining an included angle therebetween ranging from approximately 0° to approximately 180°;

whereby, said first, second and third releasable locking means can be loosened to permit said ground/floor engaging base subassembly, said upright support stanchion subassembly, and said bag engaging support subassembly to be collapsed and folded into a compact generally planar configuration for storage, yet permitting such subassemblies to be deployed for use in supporting a refuse bag wherein said ground/floor engaging base subassembly and said bag engaging support subassembly can be selectively unfolded from the compact, stored, planar configuration and deployed in selected ones of operative and/or inoperative planes for permitting support of a conventional refuse bag in either a generally vertical orientation or a generally horizontal orientation with the open end of the bag being maintained in the open state.

2. A portable, articulated, refuse bag support assembly as set forth in claim 1 wherein said T-shaped support base comprises means defining a first ground engaging support pivotally interconnected to said upright support stanchion subassembly by said first releasable locking means and a transversely extending support bar affixed to said means defining said first ground engaging support.

3. A portable, articulated, refuse bag support assembly as set forth in claim 2 wherein said means defining said first ground engaging support comprises a pair of spaced apart parallel ground engaging support bars, an intermediate ground engaging support bar positioned between and pivotally connected to said pair of parallel spaced apart ground engaging support bars, and fourth means for releasably locking said intermediate ground engaging support bar and said pair of spaced apart parallel ground engaging support bars together in any desired position defining an included angle therebetween ranging from 0° to 180°.

4. A portable, articulated, refuse bag support assembly as set forth in claim 3 wherein at least one axially extending slot is formed in at least one of said intermediate ground engaging support bar and said pair of spaced apart parallel support bars and said fourth releasable locking means comprises a bolt and nut combination with said bolt passing through said bars and the slot(s) formed in said bars for permitting said intermediate ground engaging support bar to be moved axially relative to said pair of spaced apart parallel ground engaging support bars and pivoted about said bolt so as to permit deployment of said ground engaging support bars in any desired two dimensional or three dimensional configuration.

5. A portable, articulated, refuse bag support assembly as set forth in claims 1, 2, 3 or 4 wherein said upright support stanchion assembly comprises a pair of parallel spaced apart support uprights, an intermediate support upright positioned between, and pivotally connected to, said pair of spaced apart support uprights, and fifth means for releasably locking said intermediate support upright and said pair of spaced apart support uprights together in any desired position defining an included angle ranging from 0° to 180°.

6. A portable, articulated, refuse bag support assembly as set forth in claim 5 wherein said ground/floor engaging base subassembly is pivotally secured to one end of said intermediate support upright by said first releasable locking means and the opposite end of said intermediate support upright comprises a sharpened bayonet-like projection adapted to be driven into the ground, whereby said refuse bag support assembly may be deployed utilizing said ground/floor engaging base subassembly for support or, alternatively, by pivoting said intermediate support upright relative to said pair of spaced apart support uprights through an angle sufficient to permit exposure of said sharpened bayonet-like projection and driving thereof into the ground.

7. A portable, articulated, refuse bag support assembly as set forth in claim 5 wherein at least one axially extending slot is formed in at least one of said intermediate support upright and said pair of spaced apart support uprights and said fifth releasable locking means comprises a bolt and nut combination with said bolt passing through said uprights and the slot(s) formed in said support uprights for permitting said intermediate support upright to be moved axially relative to said spaced apart support uprights for permitting axial extension and/or retraction of said upright support stanchion subassembly.

8. A portable, articulated, refuse bag support assembly as set forth in claim 7 wherein said third releasable locking means comprises a bolt and nut combination with said bolt passing through said slot(s) formed in said support uprights for permitting said bag engaging support assembly to be shifted axially along said upright support stanchion subassembly.

9. A portable, articulated, refuse bag support assembly as set forth in claims 1, 2, 3 or 4 wherein said pair of mating telescopically, interconnected C-shaped support elements each comprise an intermediate leg, a first tubular member affixed to one end of said leg and extending normal thereto, and a second tubular member affixed to the opposite end of said leg and extending normal thereto and parallel to said first tubular leg, the outside diameter of one of said first and second tubular members being slightly smaller than the inside diameter of the other of said first and second tubular members so that said first tubular member on one of said C-shaped elements can be telescopically mounted with respect to said second tubular member on the other of said C-shaped elements and said first tubular member on the other of said C-shaped elements can be telescopically mounted with respect to said second tubular member on said one of said C-shaped elements.

10. A portable, articulated, refuse bag support assembly as set forth in claim 9 wherein one set of said telescopically mounted first and second tubular members on respective different ones of said pair of C-shaped support elements are provided with axially extending aligned slots, and said second releasable locking means comprises a bolt and nut combination wherein said bolt passes through said slots so as to permit locking of said first and second tubular members together in any desired position.

* * * * *